United States Patent [19]

Scott

[11] 4,193,270

[45] Mar. 18, 1980

[54] REFRIGERATION SYSTEM WITH COMPRESSOR LOAD TRANSFER MEANS

[76] Inventor: Jack D. Scott, 486 Madrona St., Twin Falls, Id. 83301

[21] Appl. No.: 881,415

[22] Filed: Feb. 27, 1978

[51] Int. Cl.[2] ..... F25B 7/00

[52] U.S. Cl. ..... 62/175; 62/196 A; 62/510

[58] Field of Search ..... 62/510, 175, 196 A, 62/228 D, 117; 236/1 EA

[56] References Cited

U.S. PATENT DOCUMENTS

| | | | |
|---|---|---|---|
| 3,234,749 | 2/1966 | Quick | 62/129 |
| 3,580,006 | 5/1971 | Quick | 62/196 |
| 3,766,745 | 10/1973 | Quick | 62/196 |
| 3,828,152 | 8/1974 | Charmeil et al. | 200/83 |

*Primary Examiner*—William E. Wayner
*Assistant Examiner*—Harry Tanner
*Attorney, Agent, or Firm*—Frank J. Dykas

[57] ABSTRACT

A closed cycle, multiple compressor, multiple evaporator, refrigeration system of the type particularly adapted to supermarket applications having a common condenser, a multiplicity of refrigerated fixtures with associated evaporators for cooling, all operating at the same temperature and pressure, all discharging into a common compressor suction header and a series of parallel compressors pumping from the common suction header to the condenser, together with a second set of refrigerated fixtures having evaporators operating at a lower pressure than that of the first multiplicity of evaporators, discharging into a second, lower pressure, suction header, from where its effluent refrigerant is pumped by a second compressor system back to the common condenser. The two compressor suction headers are connected by a conduit containing a pressure regulating valve which senses suction pressure in the lower pressure system and, as necessary, transfers refrigerant from the higher pressure suction header to the lower pressure suction header so as to fully utilize the pumping capacity of the compressor system pumping from the low pressure suction header.

11 Claims, 3 Drawing Figures

REFRIGERATION SYSTEM WITH COMPRESSOR LOAD TRANSFER MEANS

FIELD OF INVENTION

This invention relates to a means for load sharing between various refrigeration compressors of a multiple compressor, parallel, refrigeration system wherein the total evaporator, refrigerant load is comprised of a plurality of evaporators which are operating at different refrigerant temperatures and pressures. Multiple compressor, parallel, system refrigeration plants are typically utilized in situations where the refrigeration load or demand varies from time to time, such as in supermarkets, manufacturing and food processing plants.

DESCRIPTION OF PRIOR ART

There is an increasing demand for more energy efficient means of providing refrigeration for today's food processing, storage and sales industries. These industries have for many years been confronted with an increasing demand for refrigeration coupled with increasing costs of energy to run the refrigeration systems.

In the earliest stages of development of refrigeration technology each refrigeration fixture, cooled by its own evaporator, was supplied by a separate system, with separate compressors, condensers and control systems. A development which quickly followed was use of a single compressor and condenser to supply multiple evaporators, functioning independently of one another.

The basic principle underlying the multiple evaporator refrigeration system was that one compressor could pump the low pressure, gaseous, refrigerant effluent from the evaporators into a common condenser. The evaporators would be flooded through their respective thermal expansion valves from the common supply of high pressure liquid refrigeration from the condenser.

The typical multiple evaporator system in common use for many years and in production today, utilizes a thermal expansion valve and evaporator pressure regulator valve for each separate evaporator. The evaporator pressure regulator valve, located at the discharge of the evaporator, is set to control the pressure within the evaporator, and is thereby used to fix the saturation temperature of refrigerant in the evaporator. The thermal expansion valve senses the temperature of the evaporator near the discharge, and in conjunction with an input for evaporator pressure, operates to admit liquid refrigerant into the evaporator as necessary to keep the evaporator in a nearly flooded condition.

Single compressor, multiple evaporator, refrigeration systems such as just described work satisfactorily in applications where the total refrigeration load is relatively small and constant.

With single compressor systems, the compressor must necessarily be sized to handle the maximum load. Engineering and economics dictate practical limitations on the capacity and horsepower of compressors for single compressor systems. And in general, compressors of over 25 horsepower are not found in common usage in supermarkets, commercial food warehouses, storage facilities and processing plants because of these considerations. But even for systems requiring less than 25 compressor horsepower, single compressor systems are not necessarily the most desireable for two additional reasons. The first of which concerns variations in load demand. The second reason is that extremely large compressors would be needed to meet the demands of numerous evaporators connected to it.

A basic requirement of the single compressor system is that the compressor be sized to meet the pumping requirements of all the evaporators operating at maximum capacity at one time.

In practice, this is not the situation usually found. For example, the refrigeration load in a supermarket on a cold winter night will be substantially below the amount of refrigeration required on a hot summer afternoon when the supermarket is full of customers opening and closing cooler doors and reaching into open refrigerated display cases.

During these periods of low refrigeration demand the evaporator pressure regulator valves for the various evaporators will be discharging less gaseous refrigerant from the evaporators to the suction of the compressor. This can result in serious inefficiencies if one large compressor is used. During periods of low demand the compressor will draw down the pressure in its suction header thereby increasing the pumping head and possibly damaging the compressor itself.

Numerous and varied control systems have been developed over the years to avoid compressor damage in such situations. Two methods well known in the art involve cycling the compressor on and off during periods of low demand, and load by-pass systems. While these systems are effective to protect the compressor they are inefficient in other respects. Cycling a large compressor on and off wastes power and usually shortens compressor lifetime. Load by-passing, of course, represents a total waste of energy and pumping power.

A practical solution to these problems inherent to the single, large compressor system has been well known in the art for many years. A series of smaller compressors, connected in parallel are used in lieu of one large compressor. If, for example, the maximum design refrigeration load was 80 tons, four compressors capable of pumping the refrigerant necessary for 20 tons each of cooling would be installed, instead of one compressor with four times the capacity.

The control system normally installed in parallel compressor systems senses the common suction header pressure for the four compressors and turns the compressors on and off in sequence as necessary to meet pumping demands. In this way the amount of pumping capacity being utilized at any given time will be roughly equivalent to the demand. This can represent significant power savings and operating cost reductions, particularly in supermarket applications.

There is, however, one significant problem remaining which is common to both single and parallel compressor systems which supply multiple evaporators. That is, the compressor suction pressure must be lower than the pressure in the lowest pressure, coldest, evaporator connected to the system. If an evaporator designed to provide cooling, but not freezing were connected in parallel with an evaporator designed to maintan subzero temperatures the pressure in the compressors' suction header would have to be lower than the design pressure of the subzero evaporator.

For example, the design pressure for an evaporator contained in a supermarket beverage cooling fixture using R-502 Refrigerant normally ranges from 50 to 55 psi and the design pressure for an evaporator designed for use in a supermarket frozen food fixture using R-502 normally ranges from 13 to 15 psi. If both evaporators were connected to a common discharge, compressor suction, header the pressure in that suction header would have to be maintained below 13 psi. If it were not, then there would be a back pressure against the evaporator pressure regulator valve for the colder evaporator, hence no discharge of gaseous refrigerant from that evaporator.

The net result is that the refrigerant discharge from the higher pressure, warmer, evaporator operating at 50 to 55 psi would have to be substantially reduced as it entered the suction header before it was again pumped into the high pressure side of the refrigeration system. To accomplish this pressure reduction, the pumping capacity of the system would have to be necessarily increased in order to draw down the pressure in the common discharge header. Two inefficiencies become readily apparent; the first is the cost of pumping refrigerant across a greater pressure differential than is necessary; the second is the increased equipment costs incurred through the requirement for more pumping capacity.

Since pumping across the minimum possible pressure differential always results in savings in pump operating costs and smaller pump capacity equipment requirements, parallel and single compressor systems are usually designed to serve evaporators operating at relatively uniform refrigerant temperatures and pressures. In the case of the modern supermarket, two parallel compressor systems are commonly installed. The first parallel compressor system pumps from the evaporators of the fixtures used for cooling and a second parallel compressor system from the evaporators of the fixtures used for freezing. For the past several years this type of general classification of evaporators, those for freezing and those for cooling has been the accepted catagorization for determining to which compressor the evaporators are connected.

In addition to the advantages of the parallel compressor system previously described, there remains one additional advantage and that is the ability to handle the defrosting cycles of the various evaporators. It is economically essential in today's modern supermarket, that the refrigeration fixtures have automatic defrost capabilities. There are numerous designs for automatic defrosting, which are well known in the art.

One of the most common methods is to isolate the evaporator of the fixture to be defrosted from the parallel refrigeration system, and then to employ electric heaters to defrost the fixture and evaporator contained within it. Automatic defrosting is done periodically, usually by means of a shutoff valve, downstream of the evaporator pressure regulator valve; said shutoff valve being controlled by a solenoid and timer-clock.

When the shutoff valve closes, there is no flow of refrigerant through the evaporator. While the heaters are on and the fixture and evaporator coils are being defrosted, the liquid refrigerant trapped in the evaporator will evaporate and collect superheat, thereby increasing the pressure in the evaporator. When the defrost cycle is completed and the heaters are off, the shutoff valve opens and the high pressure superheated refrigerant quickly discharges to the compressor suction header.

With a parallel compressor system, this rapid, short term, increased load is easily handled by the standby pumping capacity. With a single compressor system this extra load must be handled by the single compressor and during periods of high refrigeration demand can overload the compressor and slow the rate of cooldown of the defrosted evaporator from defrost temperature back to normal operating temperature.

But even with the advantages of the parallel compressor system, there remain limitations created by operating cost considerations. In many modern applications, especially supermarkets, the use of two separate parallel compressor systems may not meet all the refrigeration needs. There are oftentimes refrigeration loads which fall halfway between the cooler and freezer classification and other loads which require super cold evaporator temperatures substantially below the temperatures and pressures of normal freezer fixture evaporators. Examples of these intermediate temperature supermarket fixtures are meat and delicatessen coolers. The ice cream display case normally requires a super cold evaporator.

These intermediate refrigeration fixtures, falling between the cooler and freezer parallel compressor systems and the super cold fixtures have traditionally been handled by separate refrigeration systems. Of course, by the use of separate compressor systems, all of the problems heretofore described as inherent to the single compressor system once again appear. Recent developments in the art aimed at solving this problem, have utilized what is commonly referred to as a satellite compressor to handle these intermediate and super cold refrigeration fixtures.

In the typical satellite compressor installation the intermediate or super cold evaporator receives its supply of high pressure liquid refrigerant from the condenser receiver of the cooler or freezer parallel compressor systems respectively. Control of temperature and refrigerant flow through the evaporator is achieved in the same manner as in the parallel system evaporators. However, the discharges from these evaporators are not returned to the parallel compressor suction header, but rather, to separate compressors which complete the refrigeration cycle by pumping the refrigerant back to the parallel compressor system's common condenser.

By utilizing the satellite compressor two significant savings are realized; the first is the elimination of the need for additional condensers, receivers, and the associated hardware for an entirely separate system; the second is that by not connecting the discharge of the intermediate or super cold evaporators to the cooler or freezer parallel compressor suction headers, we eliminate the need to reduce the suction pressures of the parallel compressor systems. This allows each parallel compressor system to operate at the highest possible suction pressure and still draw its suction from the majority of the evaporators connected to the system.

The result is a substantial operating cost savings because the parallel compressors, serving the majority of the evaporators, operating at the same temperatures and pressures, are pumping across a minimum pressure differential, and the intermediate temperature and super cold evaporators are served by separate compressors pumping across greater pressure differentials than their respective parallel compressor systems.

The drawback is, as previously stated, that the satellite compressors must be sized for the maximum loads, thereby creating unused and unneeded pumping capacity during low load periods of time. In addition, to the wasted pump capacity, problems of cycling the pump and overtaxing the pump during discharge after defrost of its evaporator are present in the satellite system.

In practice, it is common to have, during low load periods, the first stage parallel compressor running, the second stage parallel compressor cycling on and off, and the satellite compressor cycling on and off.

OBJECTS OF THE INVENTION

Accordingly, it is the basic object of this invention to provide a more efficient and less costly parallel compressor, multiple evaporator refrigeration system by means of a novel method for optimizing and maximizing the use of the pumping capacity of each compressor within the parallel compressor system.

Another object of this invention is to provide a means whereby the pumping capacity of a satellite compressor, attached to a parallel compressor system, is fully utilized at all times.

A third object of this invention is to eliminate the need for cycling, or by-passing the load of, a satellite compressor and to level the load on the satellite compressor during periods of defrosting.

A final object of this invention is to provide a means whereby a series of compressors, each serving an evaporator or evaporators, operating at different temperatures and pressures, can be connected together to create a parallel system, in which the compressor serving the coldest evaporator, or evaporators, becomes the first stage compressor and the remaining compressors are staged, in sequence, from the compressor serving the next coldest evaporator to the one serving the warmest evaporator or evaporators.

SUMMARY OF THE INVENTION

These objects are achieved in a system having a common condenser, and two separate compressors each independently pumping from an evaporator operating at a different temperature and pressure, by connecting the compressor suction header of the compressor pumping from the higher pressure evaporator to the suction header of the compressor pumping from the lower pressure evaporator by means of a connecting header containing a pressure regulating valve. This pressure regulating valve senses pressure in the low pressure compressor suction header and is preset to maintain a certain minimum pressure in the low pressure compressor suction header.

The set point, or minimum desired low pressure compressor suction header pressure, is empirically determined and is that suction pressure at which the compressor pumping from the low pressure suction header will be fully and optimally utilized. In practice it has been determined that the optimal set point for minimum pressure in the low pressure suction header should be set at that point which represents full utilization of the pumping capacity of the low pressure compressor.

During periods of low demand on the total refrigeration system the pressures in both the higher and lower pressure suction headers will be drawn down by their respective compressors. As the pressure in the low pressure compressor suction header falls below the predetermined set point of the pressure regulating valve, the valve opens, allowing gaseous refrigerant from the high pressure suction header to flow through the connecting header to the low pressure suction header as necessary to maintain the minimum preset pressure.

If the demand on the total refrigeration system falls below the preset, optimal, pumping capacity of the low pressure compressor as determined by the minimum low pressure suction header pressure, a control system operates to turn off the unneeded high pressure compressor and all of the pumping requirements of both the higher and lower pressure evaporators will be handled by the low pressure compressor. If total refrigeration demand continues to fall, the low pressure compressor may, as determined by the control system installed, be cycled on or off, or, have its pumping load by-passed.

In this manner the compressor serving the lowest pressure evaporator will always be optimally utilized first, and during periods of low refrigeration demand, a minimum number of compressors will be running or cycling on and off.

It should be readily apparent to those skilled in the art that this invention will work as well with parallel evaporator and compressor systems. The connecting header and pressure regulating valve can be used to connect the suction header of a compressor, or series of parallel compressors, serving a plurality of evaporators, all operating at approximately the same temperature and pressure, to the suction header of a compressor, or series of parallel compressors, serving a set of lower pressure evaporators. Likewise, it should be apparent that this invention can be used in applications where there are several compressors serving evaporators at widely varied temperatures and pressures.

BRIEF DESCRIPTION OF THE ACCOMPANYING DRAWINGS

DETAILED DESCRIPTION OF PREFERRED EMBODIMENTS

Figure 1:
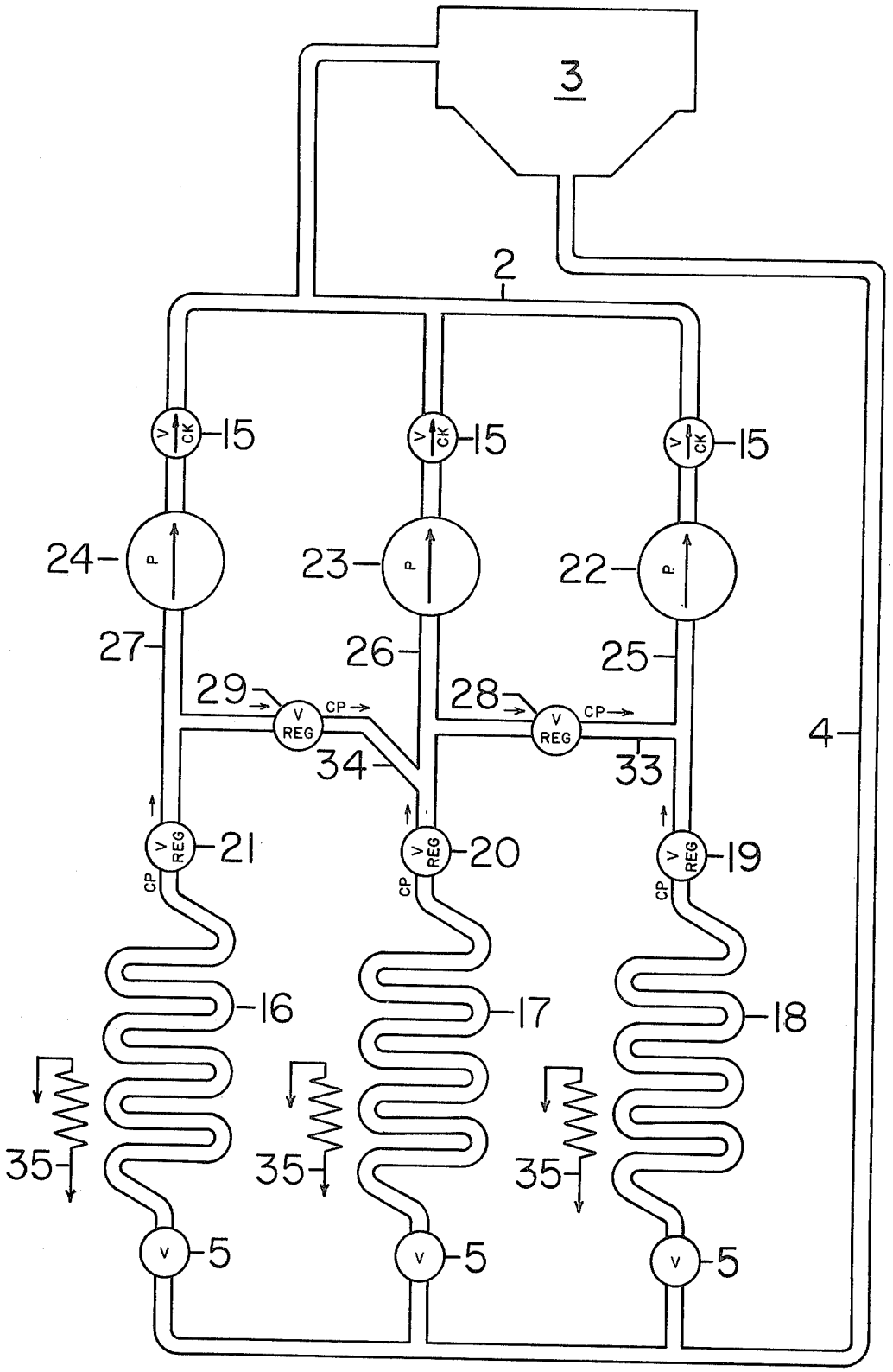
FIG. 1 is a schematic representation showing two connecting headers with pressure regulating valves in a refrigeration system having a common condensor and three compressors each pumping from separate evaporators.

FIG. 1 shows to advantage the features of this invention when used in a refrigeration system which has a common condenser 3 and three evaporators 18, 17 and 16 each being independently served by compressors 22, 23 and 24 respectively. In FIG. 1, each of the three evaporators is designed to control at a different temperature with evaporator 18 being the coldest, evaporator 17 set for an intermediate temperature and evaporator 16 for the warmest temperature.

Refrigerant is admitted to each of the three evaporators through thermal expansion valves 5 from a common refrigerant supply header 4 which, in turn, is supplied from the system condenser 3.

The evaporators 16, 17 and 18 remove heat from the fixtures to be cooled by means of passing subcooled refrigerant through the evaporators. Control over the saturation temperature of the refrigerant within each of the evaporators and the flow of refrigerant through them is accomplished by two valves, thermal expansion valves 5 located at the inlets to each of the evaporators, and evaporator pressure regulator valves 21, 20 and 19 at the discharges of each of the evaporators.

The actual pressure in each of the evaporators is controlled by evaporator pressure regulator valves. And since the saturation temperature of the refrigerant is a direct function of pressure within the evaporator. The higher the pressure in the evaporator, the higher the saturation temperature of the refrigerant entering into the evaporator through the thermal expansion valve, hence the higher the temperature at which the evaporator operates. In effect, the pressure at which the evaporator pressure regulator valves 21, 20 and 19 are set to control at determines the temperature at which the evaporators will operate at.

The thermal expansion valves 5 are designed to keep the evaporators 16, 17 and 18 in, as nearly as possible, a flooded condition. This is accomplished by the thermal expansion valves 5 through the use of two sensory inputs, one is evaporator pressure and the second is the temperature of the refrigerant in the vicinity of evaporator discharge. By combining these two inputs, thermal expansion valves 5 sense the presence of superheat at the discharge of each evaporator.

In FIG. 1 evaporator 18 is designed to control at the coldest temperature, hence its evaporator pressure regulator valve 19 is set to control at a pressure lower than that of evaporator pressure regulating valve 20 for the intermediate temperature evaporator 17. Likewise, the evaporator pressure regulating valve 21 for the warmest evaporator 16 will be set at a higher pressure than evaporator pressure regulator valve 20.

The gaseous refrigerant from evaporator 18 is discharged through evaporator pressure regulating valve 19 into the low pressure suction header 25, from where it is pumped by compressor 22 through check valve 15 into the parallel system compressor discharge header 2 for return to condenser 3. In a like manner evaporators 17 and 16, discharging through evaporator pressure regulator valves 20 and 21, pass effluent refrigerant to the intermediate and high pressure suction headers 26 and 27.

When the entire system is operating at design capacity the pressure in low pressure suction header 25 will be lower than the pressure in intermediate pressure suction header 26, which in turn is lower than the pressure in the high pressure suction header 27.

In this invention the medium pressure suction header 26 is connected to the low pressure suction header 25 by the first stage connecting header 33. The first stage pressure regulator valve 28 in the first stage connecting header 32 senses the pressure in the low pressure suction header 25. During periods of low demand on evaporator 18 low pressure compressor 22 through operation will reduce the pressure in the low pressure suction header 25 below the designed set point of the first stage pressure regulator valve 28.

The design set point is that pressure at which compressor 22 is running at optimal capacity. When the pressure in suction header 25 falls below the set point, the first stage pressure regulator valve 28 opens to discharge medium pressure gaseous refrigerant from medium pressure suction header 26 into low pressure suction header 25.

In a like manner, high pressure suction header 27 is connected to medium pressure suction header 26 by second stage connecting header 34. Second stage pressure regulator valve 29 senses the pressure in medium pressure suction header 26 and when the pressure in medium pressure suction header 26 falls below its designed pressure, the second stage pressure regulator valve 29 opens allowing the high pressure gaseous refrigerant of high pressure suction header 27 to pass through the second stage connecting header 34 to the medium pressure suction header 26.

In this manner, the gaseous refrigerant in suction headers 27 and 26 will pass through the second stage connecting header 34 and the first stage connecting header 33 to low pressure suction header 25 during periods of time of low demand on the total refrigeration system.

By such a design, low pressure compressor 22 will be pumping all of the effluent gaseous refrigerant up to its maximum design capacity. When low pressure compressor 22 reaches its maximum design capacity the pressure in low pressure suction header 25 will begin to rise and first stage pressure regulator valve 28 will close at its predetermined set point. As the load further increases medium pressure compressor 23 will turn on to pump the effluent medium pressure gaseous refrigerant in medium pressure suction header 26, that is no longer being discharged to the low pressure suction header 25 through the first stage pressure regulator valve 28. If the load on the medium pressure compressor 23 increases to the point where the pressure in the medium pressure suction header 26 rises above the set point of the second stage pressure regulator valve 29, then second stage pressure regulator valve 29 will close and high pressure compressor 24 will turn on.

In this manner, the economies of a parallel compressor system are fully utilized in that only the minimum amount of compressor capacity is operating during periods of low demand and the optimal design efficiency of each compressor is fully utilized during periods of higher demand in that each compressor, during periods of higher demand, only pumps across the minimum pressure differential.

Figure 2:
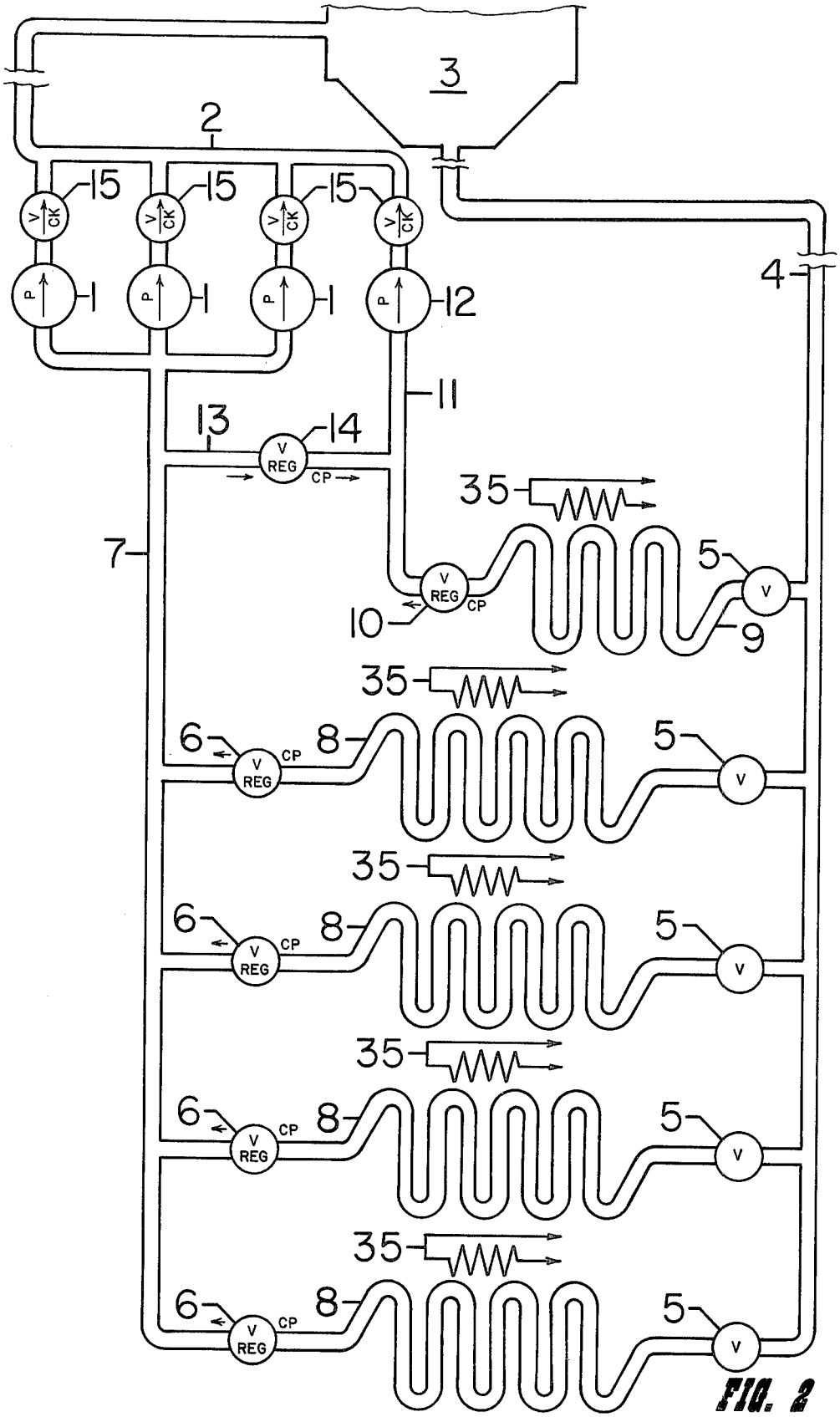
FIG. 2 is a schematic representation of a parallel compressor refrigeration system having a satellite compressor system attached to it with a connecting header and pressure regulating valve installed between the parallel system's compressor suction header and the satellite compressor's suction header.

FIG. 2 shows an embodiment of the invention that is typical of refrigeration system installations in supermarkets. Evaporators 8 with their respective thermal expansion valves 5 and evaporator pressure regulator valves 6 are all designed to operate at approximately the same temperature. Since each of the evaporators 8 are operating at the same temperature, the pressures of the gaseous refrigerant discharged through evaporator pressure regulator valves 6 are approximately equal. The parallel evaporators 8 all discharge to compressor suction header 7. Parallel system compressors 1 each draw from suction header 7 and are designed and controlled so that one compressor is running nearly continuously with the second and third compressors turning on in sequence, as necessary, as the pressure in suction header 7 increases.

This sequential control is normally accomplished by use of a pressure sensing device which senses pressure in the compressor suction header 7. When the refrigeration system is operating a first compressor 1 will normally run continuously, only turning off if it reduces pressure in the compressor suction header 7 below a predetermined set point. As load on evaporator 8 increases, pressure in suction header 7 will rise. As this pressure increases above a predetermined set point, a second compressor 1 is turned on. Likewise, if pressure in compressor suction header 7 continues to rise, a third compressor 1 will be turned on.

Similarly, as the refrigeration load decreases, the operating compressors 1 will draw the pressure in compressor suction header 7 down, and as pressure falls below predetermined set points the compressors 1, are sequentially turned off.

Evaporator 9 is designed to operate at a lower saturation temperature, hence a lower pressure. Evaporator 9 receives its refrigerant from the common refrigerant supply header 4 through its thermal expansion valve 5 and discharges its effluent refrigerant through its evaporator pressure regulator valve 10 to its own, satellited compressor 12 through its own suction header 11.

Satellite compressor 12, is connected to the parallel system and pumps its discharge through check valve 15 directly into the common compressor discharge header 2.

Because evaporator 9 is operating at a lower temperature and pressure, the pressure in suction header 11 is necessarily lower than would be required in suction header 7. To prevent the inefficiencies created by reducing the pressure in suction header 7 and discharging the effluent refrigerant from evaporator 9 into suction header 7 and thereby requiring the parallel system compressors 1 to pump across a greater pump head than is necessary, the effluent from evaporator 9 is discharged into a separate suction header 11 and satellite compressor 12 is installed.

Connecting header 13 containing pressure regulating valve 14 is installed between suction headers 7 and 11. Pressure regulating valve 14 senses the pressure of suction header 11. When the refrigeration demand on evaporator 9 is low and when the pressure in suction header 11 falls below a designed set point, pressure regulator valve 14 opens and the higher pressure effluent gaseous refrigerant in suction header 7 flows through connecting header 13 to suction header 11.

In this manner, satellite compressor 12 is always operating at its maximum design capacity or, in the event of extremely low refrigeration demand on the entire system, carrying the entire pumping requirements of the refrigeration system.

Figure 3:
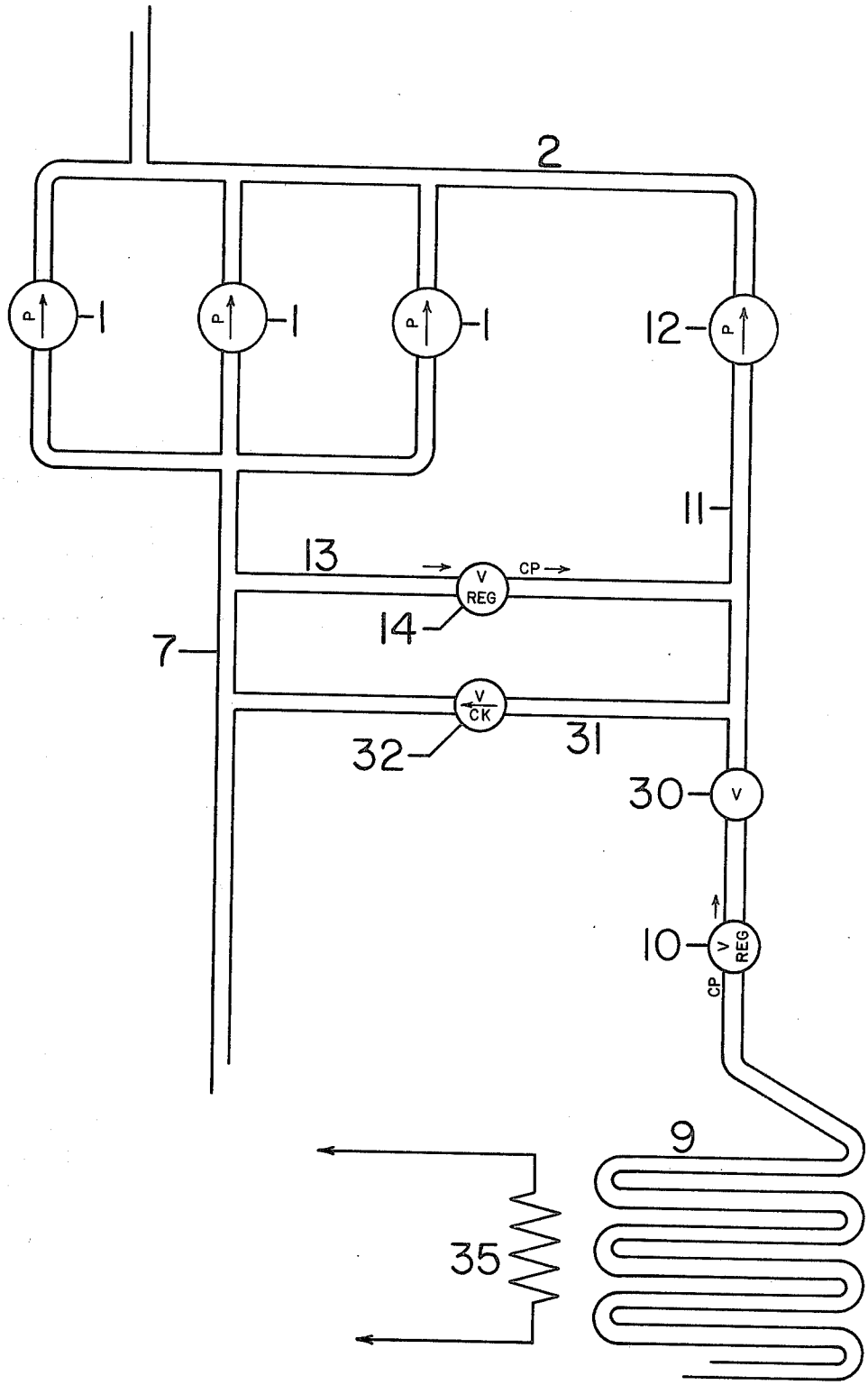
FIG. 3 is a fragmentary schematic representation showing the compressor suction headers of a parallel compressor system and satellite compressor interconnected by means of a connecting header with pressure regulating valve and defrost overload connecting header with a check pressure relief valve.

In FIG. 3 an additional embodiment of the invention is shown to advantage. In this embodiment provisions are made to transfer a load back and forth between suction headers 11 and 7 during time periods when evaporator 9 is in a defrost cycle.

FIG. 3 illustrates one of the more common methods of controlling a defrost cycle, and that is to install the defrost suction shutoff valve 30 in suction header 11 upstream of compressor 12. During the defrost cycle shutoff valve 30 closes, thereby stopping the return flow of effluent gaseous refrigerant from evaporator 9. When shutoff valve 30 is closed, electrical heaters 35 in the vicinity of evaporator 9 are turned on to remove frost from the cooling coils of evaporator 9.

In installations not using the connecting header 13 and pressure regulating valve 14, compressor 12 would necessarily have to be shut off or a load by-pass system installed during the time when shutoff valve 30 is closed. By using this invention, during periods of time when evaporator 9 is in the defrost cycle and shutoff valve 30 is closed, pressure regulating valve 14 allows gaseous effluent refrigerant from compressor suction header 7 to flow through connecting header 13 to compressor 12, thereby allowing compressor 12 to be run at its maximum designed load even while evaporator 9 is in defrost.

At the end of evaporator's 9 defrost cycle, shutoff valve 30 opens and the now high pressure, hot gaseous effluent refrigerant in evaporator 9 is allowed to pass through evaporator pressure regulating valve 10 and the now open shutoff valve 30 into suction header 11. Check pressure relief valve 32 is installed in overload connecting header 31 which connects suction header 11 to suction header 7. As the shutoff valve 30 opens and the hot refrigerant enters into suction header 11 at the end of the defrost cycle, pressure in suction header 11 rapidly increases. If the pressure in suction header 11 increases above the pressure in suction header 7 then check pressure relief valve 32 opens, discharging the high pressure effluent refrigerant from suction header 11 to suction header 7.

By the operation of check pressure relief valve 32, the fluctuations in load on compressor 12 are further minimized, thus minimizing the wear and tear on compressor 12.

Having thus described in detail preferred designs which embody the concepts and principles of the invention and which accomplish the various objects, purposes and aims thereof, it is to be appreciated and will be apparent to those skilled in the art that many physical changes could be made in this invention without altering the inventive concepts and principles embodied therein. Hence, it is intended that the scope of this invention be limited only to the extent indicated in the appended claims.

I claim:

1. A closed cycle, multiple compressor, multiple evaporator, refrigeration system comprising:

condenser means for receiving compressed gaseous refrigerant from a plurality of compressor means and condensing it to a liquid;

a first refrigerated fixture having an evaporator means associated with and cooling said fixture;

a first compressor means for compressing gaseous effluent refrigerant and returning it to said condenser means;

a first suction header means for receiving gaseous effluent refrigerant from said first evaporator means and transferring it to said first compressor means;

a second refrigerated fixture having an evaporator means associated with and cooling said fixture;

said second evaporator means operating at a higher pressure than said first evaporator means;

a second compressor means for compressing gaseous effluent refrigerant and returning it to said condenser means;

a second suction header means for receiving gaseous effluent refrigerant from said second evaporator means at a pressure higher than the pressure in the first suction header means and transferring it to said second compressor means;

means for transferring gaseous effluent refrigerant from said second suction header means to the first suction header means to maintain a minimum amount of gaseous effluent refrigerant flow to said first compressor means;

supply header means for supplying compressed liquid refrigerant from said condenser means to said first and second evaporator means.

2. The refrigeration system of claim 1 wherein said means for transferring gaseous effluent refrigerant from the second suction header means to the first suction header means comprises:

a conduit connecting the first suction header means to the second suction header means; and a pressure regulating valve disposed within said conduit for sensing the pressure within the first suction header means and regulating the flow of gaseous refrigerant through said conduit from the second suction header means to the first suction header means so as to maintain a minimum pressure in said first suction header means.

3. The refrigeration system of claim 1 wherein said first refrigerated fixture further comprises:

means for stopping refrigerant flow from said first evaporator means to said first suction header means;

means for defrosting said first refrigerated fixture when said refrigerant flow is stopped.

4. The refrigeration system of claim 3 wherein said refrigeration system further comprises:

a second conduit connecting the first suction header means to the second suction header means;

means for transferring refrigerant from the first suction header to the second suction header when the pressure in the first suction header is greater than the pressure in the second suction header disposed within said second conduit.

5. The refrigeration system of claim 4 wherein said means for transferring refrigerant is a check pressure relief valve.

6. A closed cycle, multiple compressor, multiple evaporator, refrigeration system comprising:

condenser means for receiving compressed gaseous refrigerant from a plurality of compressor means and condensing it to a liquid;

a first refrigerated fixture having an evaporator means associated with and cooling said fixture;

a first compressor means for compressing gaseous effluent refrigerant and returning it to said condenser means;

a first suction header means for receiving gaseous effluent refrigerant from said first evaporator means and transferring it to said first compressor means;

a second plurality of refrigerated fixtures having a like plurality of evaporator means associated with and cooling said fixtures;

said second evaporator means operating at a higher pressure than said first evaporator means;

a second compressor means for compressing gaseous effluent refrigerant and returning it to said condenser means;

a second suction header means for receiving gaseous effluent refrigerant from said second evaporator means at a pressure higher than the pressure in the first suction header means and transferring it to said second compressor means;

means for transferring gaseous effluent refrigerant from said second suction header means to the first suction header means to maintain a minimum amount of gaseous effluent refrigerant flow to said first compressor means;

supply header means for supplying compressed liquid refrigerant from said condenser means to said first and second evaporator means.

7. The refrigeration system of claim 6 wherein said means for transferring gaseous effluent refrigerant from the second suction header means to the first suction header means comprises:

a conduit connecting the first suction header means to the second suction header means; and a pressure regulating valve disposed within said conduit for sensing the pressure within the first suction header means and regulating the flow of gaseous refrigerant through said conduit from the second suction header means to the first suction header means so as to maintain a minimum pressure in said first suction header means.

8. The refrigeration system of claim 6 wherein said second compressor means comrises:

a plurality of regrigerant compressors each connected in parallel with the other for pumping refrigerant from the second suction header to the means for condensing.

9. The refrigeration system of claim 6 wherein said first refrigerated fixture further comprises:

means for stopping refrigerant flow from said first evaporator means to said first suction header means;

means for defrosting said first refrigerated fixture when said refrigerant flow is stopped.

10. The refrigeration system of claim 9 wherein said refrigeration system further comprises:

a second conduit connecting the first suction header means to the second suction header means;

means for transferring refrigerant from the first suction header to the second suction header when the pressure in the first suction header is greater than the pressure in the second suction header disposed within said second conduit.

11. The refrigeration system of claim 10 wherein said means for transferring refrigerant is a check pressure relief valve.

* * * * *